US006575713B2

(12) United States Patent
Ohtachi et al.

(10) Patent No.: US 6,575,713 B2
(45) Date of Patent: Jun. 10, 2003

(54) VACCUM PUMP

(75) Inventors: Yoshinobu Ohtachi; Hirotaka Namiki; Akira Yamauchi, all of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/740,663

(22) Filed: Dec. 19, 2000

(65) Prior Publication Data

US 2001/0012488 A1 Aug. 9, 2001

(30) Foreign Application Priority Data

Dec. 21, 1999 (JP) ..... 11-363097
Jul. 6, 2000 (JP) ..... 2000-205017

(51) Int. Cl.[7] ..... F04B 17/00

(52) U.S. Cl. ..... 417/353; 417/363; 417/423.4; 417/423.14; 417/423.15

(58) Field of Search ..... 417/353, 363, 417/423.4, 423.14, 423.15

(56) References Cited

U.S. PATENT DOCUMENTS 4,184,810 A * 1/1980 Dyhr et al. ..... 417/363
4,294,493 A * 10/1981 Sindlinger et al. ..... 308/10
4,541,772 A * 9/1985 Becker ..... 415/90
5,166,566 A * 11/1992 Bernhardt et al. ..... 310/90.5

FOREIGN PATENT DOCUMENTS

| | | |
|---|---|---|
| DE | 3239328 | 4/1984 |
| DE | 3537822 | 4/1987 |
| EP | 0445691 | 9/1991 |
| EP | 0768467 | 4/1997 |
| JP | 61294191 | 12/1986 |

* cited by examiner

*Primary Examiner*—Charles G. Freay
*Assistant Examiner*—Michael K. Gray
(74) *Attorney, Agent, or Firm*—Adams & Wilks

(57) ABSTRACT

There is provided a vacuum pump which suppresses the propagation of vibrations to an external container without the use of a damper. The vacuum pump has an outer cylindrical portion, a rotor portion and a stator portion accommodated within the outer cylindrical portion to define a transferring portion for a gas sucked from an inlet port, a magnetic bearing for supporting the rotor portion with respect to the stator portion, a motor for rotating the rotor portion with respect to the stator portion, and a base for supporting the outer cylindrical portion and the stator portion. A vibration absorbing member is interposed between the stator portion and the base, which has a natural frequency $F=(f1+f3)/2\pm(f1-f3)/4$, provided that f1, f2 and f3 respectively denote a natural frequency of nutation in conical mode, a natural frequency in parallel mode and a natural frequency of procession in the conical mode, when the rotor portion is rotated at a rated speed.

12 Claims, 7 Drawing Sheets

VACCUM PUMP

BACKGROUND OF THE INVENTION

1. Field of the Invention

The present invention relates to a vacuum pump that is communicated with an external container to suck gas contained within the external container, and more particularly, to a vacuum pump that can suppress the propagation of vibrations to the external container without the use of dampers.

2. Description of the Related Art

A vacuum pump, such as a turbo-molecular pump or a thread groove-type pump, is known, which is communicated with an external container to suck gas contained within the external container. The vacuum pump is widely used to conduct a vacuum process in which a processing gas within a chamber is exhausted during dry etching, CVD or the like, with a semiconductor manufacturing apparatus, a liquid crystal manufacturing apparatus or the like. The vacuum pump is also used in a measuring apparatus for an electronic microscope or the like.

The vacuum pump is constructed such that an outer cylindrical portion to be communicated with the external container is fixed at one end thereof to a base so that the gas within the external container is introduced into the interior of the outer cylindrical portion at the one end thereof. In the interior of the outer cylindrical portion, a rotor portion and a stator portion are disposed, which are connected directly to or connected through other components to the base. The outer circumferential surface of one of the rotor portion and the stator portion are confronted with the inner circumferential surface of the other to define a gas transferring section for transferring the gas between the rotor portion and the stator portion.

By the rotation of the rotor portion, the gas within the gas transferring section is transferred, and the gas within the external container is sucked therein.

In case of a turbo-molecular pump, a plurality of spacers are disposed on the stator portion coaxially to the rotor portion, and stator blades are respectively disposed between the adjacent spacers to project toward the rotor portion. Rotor blades are disposed on the rotor portion to respectively project into spacers between the adjacent stator blades. The rotor blades, when rotated, collide against and thus transport the gas molecular.

In case of a thread groove-type pump, a thread groove is formed on one of the confronted circumferential surfaces of the rotor portion and the stator portion. Thus, when the rotor is rotated, the gas is transferred using the gas viscosity.

The vacuum pump described above is applied, for instance, to an electronic microscope or other apparatuses, that are largely affected by minute vibrations.

In a related art, the vacuum pump is formed of material which can easily propagates vibrations therethrough, that is, the rotor portion and the base are formed of aluminum alloy (the logarithmic attenuation ratio thereof with respect to vibrations is about 0.0002), and the outer cylindrical portion and bolts for connecting components together are formed of SUS alloy (the logarithmic attenuation ratio thereof with respect to vibrations is about 0.01). Consequently, the vibrations associated with the rotation of the rotor portion are propagated through the stator portion and the outer cylindrical portion to adversely affect the external apparatus connected thereto.

For this reason, as shown in FIG. 4, a technical solution has been proposed, in which a damper D is interposed between a pipe C of the external container and the outer cylindrical portion 116 of the vacuum pump 100 to prevent vibration caused due to the rotation of the rotor portion or the like from being propagated to the external container connected to the vacuum pump.

As an example of the damper D, a thin, SUS-made cylindrical member whose circumferential surface is bent into a bellows shape, and which is coated with a silicon rubber or the like is used. This damper D is designed such that the natural frequency of the entire damper D system is 20 Hz or less in order to have the excellent damping property. During the use of the vacuum pump 100, the damper D is tightened with a hose band or the like externally mounted to the damper D.

However, the use of the damper D as a solution of avoiding the propagation of the vibrations of the vacuum pump 100 requires an extra space in the axial direction corresponding to the length of the damper D. The space required for mounting the damper D to the vacuum pump 100 is generally about 10 cm in the axial direction. The increased cost corresponding to the damper D is also required.

The mounting and removable of the damper D requires labor and is troublesome. The property of the damper D may be changed depending on the mounting state of the damper D.

Additionally, the bellows-shaped member described above can not be formed of a high-rigidity member or a thick member because the bellows-shaped member is required to exhibit an excellent vibration suppressing effect. For this reason, if the excessive force due to the rotational torque of the rotor portion acts on the member, the member may be broken. It is conceivable to arrange a reinforcing member such as a rotation preventive member in order to eliminate the breakage, but the arrangement of the reinforcing member requires an extra cost and makes the structure of the apparatus complicated. Consequently, the maintenance work such as the mounting and removal becomes troublesome.

Further, the natural frequency of the entire pump is about 10 Hz, which is close to the natural frequency of the precession of the rotor (several Hz) generated in the case where the rotor portion of the vacuum pump is supported by magnetic bearings. Consequently, the rotational shift of the rotor portion is likely to be increased due to an external force such as an earthquake, and in some cases, the protection function is activated to stop the rotor portion.

As described above, the related vacuum pump requires the damper to be mounted to the connecting portion to the external container in order to prevent the propagation of the vibrations to the external container, but the mounting of the damper increases the cost and labor and requires the extra space, resulting in the lowering of handling ability.

Further, the related vacuum pump as described above has a built-in motor, and further a certain type of the vacuum pump uses magnetic bearings as bearings. For this reason, magnetic fluxes caused by magnets of the motor and magnetic bearings may leak externally to adversely affect the connected external container such as a vacuum apparatus.

Furthermore, the related vacuum pump as described above is designed such that the outer cylindrical member to be fixed to the vacuum apparatus is electrically connected to cores of electromagnets of the motor and magnetic bearings. In the case where a switching amplifier is used as a driving amplifier for the electromagnets of each of the motor and magnetic bearings, if the voltage applied to the coil of the electromagnet by the switching amplifier is varied, the current excited in the core of the electromagnet may be transmitted through the outer cylindrical member to the external vacuum apparatus, causing an electric noise to adversely affect the vacuum apparatus.

As described above, the related vacuum pump suffers from the generated vibrations, leakage of magnetic flux, and electric noise, which lowers performance, reliability and service life of the vacuum apparatus connected to the vacuum pump.

As a technical solution for eliminating the leakage of magnetic flux to the apparatus connected to the vacuum pump, a technique is known in which the exterior of the outer cylindrical member is housed by a shielding member formed of high permeability material, such as a silicon steel plate, for shielding the magnets of the motor and magnetic bearing. However, this technical solution has a problem in that the vacuum pump is made large in size due to the provision of the shielding member in order to obtain the sufficient shielding effect. It is conceivable to arrange a shielding member just around the exterior of the motor or magnetic bearing. However, because the density of the leaking magnetic flux in this location is high, the thick shielding member is required to provide the sufficient shielding effect, resulting in the increased size and cost of the vacuum pump.

SUMMARY OF THE INVENTION

The present invention has been made in order to solve the problems mentioned above. Accordingly, a first object of the present invention is to provide a vacuum pump which can suppress the propagation of vibrations to an external container connected to the vacuum pump without the use of damper.

In addition to the first object, a second object of the present invention is to provide a vacuum pump which can avoid the external leakage of magnetic flux while suppressing the size increase and cost increase.

In addition to the first object, a third object of the present invention is to provide a vacuum pump which can suppress the transmittance of an electric noise to an external container connected thereto.

To attain the first object, the present invention provides a vacuum pump (a first arrangement) comprising: an outer cylindrical portion to be connected to an external container, the outer cylindrical portion having one end portion provided with an inlet port through which a gas within the external container is sucked; a rotor portion rotatably accommodated within the outer cylindrical portion; a stator portion disposed within the outer cylindrical portion, the stator portion and the rotor portion cooperatively defining a transferring portion for transferring the gas sucked through the inlet port; a magnetic bearing for floatingly supporting the rotor portion; a motor portion for rotatingly driving the rotor portion; a base supporting the outer cylindrical portion and the stator portion at the other end portion of the outer cylindrical member; and a vibration absorbing member, interposed between at least one of the outer cylindrical portion and the stator portion and the base, for displaceably supporting the at least one of the outer cylindrical portion and the stator portion with respect to the base, characterized in that the vibration absorbing member has a natural frequency F meeting the following formula:

$$F=(f1+f3)/2\pm(f1-f3)/4$$

where f1, f2 and f3 respectively denote a natural frequency of nutation in conical mode, a natural frequency in parallel mode and a natural frequency of procession in the conical mode, when the rotor portion is rotated at a rated speed.

In a vacuum pimp comprising: an outer cylindrical portion to be connected to an external container, the outer cylindrical portion having one end portion provided with an inlet port through which a gas within the external container is sucked; a rotor portion accommodated within the outer cylindrical portion; a stator portion disposed within the outer cylindrical portion to define a gas transferring portion in cooperation with the rotor portion; a magnetic bearing for supporting the rotor portion with respect to the stator portion in thrust and radial directions; a motor portion rotating the rotor portion with respect to the stator portion; and a base supporting the outer cylindrical portion and the stator portion at the other end portion of the outer cylindrical portion, vibrations caused on the motor portion and the magnetic bearing are propagated through the stator portion to the base, and further propagated from the base through the outer cylindrical portion to the external container.

Therefore, if the vibration absorbing member is interposed between the stator portion and the base so that the stator portion is displaceably supported to the base, the vibrations caused on the motor portion and the magnetic bearing are propagated from the stator portion to the base after the vibrations are absorbed and attenuated by the vibration absorbing member. Accordingly, it is possible to suppress the propagation of the vibrations to the external container. Further, if the vibration absorbing member is interposed between the outer cylindrical portion and the base so that the outer cylindrical portion is displaceably supported to the base, the vibrations caused on the motor portion and the magnetic bearing are propagated from the base to the outer cylindrical portion after the vibrations are absorbed and attenuated by the vibration absorbing member. Consequently, it is possible to suppress the propagation of the vibrations to the external container.

In the present invention, by using the vibration absorbing member having the natural frequency F meeting the above-noted relationship with respect to the natural frequencies f1, f2 and f3 of the magnetic bearing, the natural frequency of the vibration absorbing member can be set not to close to the natural frequencies of the vacuum pump and the magnetic bearing. Accordingly, the rotational shift of the rotor portion is difficult to be increased due to the external force such as an earthquake, and the rotor portion can be supported stably with respect to the stator portion.

It is sufficient that the vibration absorbing member is partially disposed between at least one of the outer cylindrical portion and the stator portion, and the base. For example, the vibration absorbing member is located at a central portion of each of the segments obtained by dividing a clearance between the outer cylindrical portion or the stator portion, and the base at equal angular intervals with respect to the axis.

The vacuum pump of the first arrangement can be constructed as a vacuum pump in which the vibration absorbing member includes a silicon gel (a second arrangement).

The silicon gel can reduce the rate of the vibration propagation, especially from the low frequency, one or more orders, and thus it is possible to remarkably suppress the propagation of the vibrations.

Each of the vacuum pumps of the first and second arrangements can be constructed as a vacuum pump, in which the vibration absorbing member is interposed between the stator portion and the base, and displacement restricting means is provided for restricting a range where the stator portion is displaceable with respect to the base (a third arrangement).

In the vacuum pump arranged such that the vibration absorbing member is interposed between the stator portion and the base, the stator portion is displaceably supported with respect to the base. For this reason, the stator is displaced with respect to the base when the external force such as the earthquake occurs. The clearance between the stator portion and the rotor portion is set to be as small as possible for the purpose of transferring the sucked gas without escaping toward the inlet port side. For this reason, if the stator portion is displaced with respect to the base due to the external force, then the stator portion may be contacted with the rotor portion to damage components such as rotor blades.

Therefore, it is preferable to provide the vacuum pump with the displacement restricting means for restricting the range where the stator is displaceable with respect to the base, thereby restricting the displaceable range of the stator when the external force occurs and avoiding the contact between the stator portion and the rotor portion.

In the third arrangement, the vacuum pump can be constructed such that: the stator portion includes a protruded portion protruded substantially parallel to a plane defined by the base; a plurality of restricting holes are arranged circumferetially in the protruded portion; the displacement restricting means includes restricting bolts and restricting members, the restricting bolts being formed of a material higher in rigidity than that of the vibration absorbing member, each of the restricting bolts being loosely inserted into the respective restricting holes with a leading end thereof fixed to the stator portion; and each of the restricting member has a restricting cylinder that is fixed around a shaft of each of the restricting bolts, and that is spaced from an circumferetial surface of each of the restricting holes of the protruded portion, and two disk portions that are extended outwardly from respective end portions of the restricting cylinder and that are disposed opposite from each other with respect to the protruded portion while being spaced from the protruded portion (a fourth arrangement).

To attain the first object, the present invention provides a vacuum pump (a fifth arrangement) comprising: a flange portion to be connected to an external container, the flange portion having an inlet port through which a gas within the external container is sucked; an outer cylindrical portion having one end side connected to or integral with the flange portion; a base connected to the other end side of the outer cylindrical portion, the base, the flange portion and the outer cylindrical portion cooperatively defining a hollow portion communicating with an interior of the external container through the inlet port; a stator portion supported to the base, and accommodated within the hollow portion; a rotor portion accommodated within the hollow portion; a bearing rotatably supporting the rotor portion with respect to the stator portion; a motor portion for rotatingly driving the rotor portion, supported by the bearing, with respect to the stator portion; and vibration absorbing means, including a material having a vibration absorbing property, for reducing propagation of vibration using elastic and/or viscous property, the vibration absorbing means being disposed at at least one of the flange portion, the outer cylindrical portion, the base, the stator portion, and joint portions respectively connecting two members selected from the flange portion, the outer cylindrical portion, the base, and the stator portion.

In the vacuum pump of the fifth arrangement, the vibration absorbing means, including a material having a vibration absorbing property, for reducing propagation of vibration using elastic and/or viscous property, is disposed at at least one of the flange portion, the outer cylindrical portion, the base, the stator portion, and joint portions respectively connecting two members selected from the flange portion, the outer cylindrical portion, the base, and the stator portion.

For this reason, the vibrations caused on the motor and the bearing in the interior of the vacuum pump when the rotor portion is rotated are surely reduced by the vibration absorbing means, and unlikely to be propagated to the flange portion. The vibrations caused on the motor and the bearing are propagated to the external container after being reduced by the vibration absorbing means. Accordingly, it is possible to reduce the propagation of the vibrations to the external container without using a solution in a related art in which a vibration absorbing member, such as a damper, is arranged between the flange portion and the external container.

The vibration absorbing means may be disposed at the flange portion, the outer cylindrical portion, the base and/or the stator portion, and/or may be disposed at the joint portion between the flange portion and the outer cylindrical portion, the joint portion between the outer cylindrical portion and the base, and/or the joint portion between the stator portion and the base. In the case where the vibration absorbing means is disposed at the flange portion, the outer cylindrical portion, the base and/or the stator portion, these members may be partially or entirely formed of a material having the vibration absorbing property, or the material having the vibration absorbing property or a member having the vibration absorbing property may be added to an available flange portion, outer cylindrical portion, base and/or stator portion. In the case where the vibration absorbing means is disposed at the joint portion between the flange portion and the outer cylindrical portion, the joint portion between the outer cylindrical portion and the base, and/or the joint portion between the stator portion and the base, a joint member(s) may be interposed between the flange portion and the outer cylindrical portion, between the outer cylindrical portion and the base, and/or between the stator portion and the base, and the joint member may be partially or entirely formed of the material having the vibration absorbing property, or the material having the vibration absorbing property or the member having the vibration absorbing property may be added to the joint member. The flange portion, the outer cylindrical portion and the vibration absorbing material therebetween may be formed integrally, the outer cylindrical portion, the base and the vibration absorbing material therebetween may be formed integrally, and the stator portion, the base, and the vibration absorbing material therebetween may be formed integrally.

The external container may be a chamber or the like of a semiconductor manufacturing apparatus or a electronic microscope, in which a vacuum is maintained, or may be a pipe connected to a container such as the chamber. The flange portion may have the inlet portion connected to the container such as the chamber to suck the gas directly from the container, or may have the inlet portion connected to the pipe connected to the chamber or the like to suck the gas from the pipe.

The vacuum pump of the fifth arrangement can be constructed such that: the outer cylindrical portion has an outlet port through which the gas within the hollow portion is discharged; and the vibration absorbing means is disposed at at least one of the flange portion, the outer cylindrical portion and the joint portion connecting the outer cylindrical portion and the flange portion (a sixth arrangement).

Each of the vacuum pumps of the fifth and sixth arrangements can be constructed such that: the base has an outlet port through which the gas within the hollow portion is discharged; and the vibration absorbing means is disposed at at least one of the flange portion, the outer cylindrical portion, the base, and joint portions respectively connecting two members selected from the flange portion, the outer cylindrical portion, and the base (a seventh arrangement).

Each of the vacuum pumps of the fifth to seventh arrangements can be constructed such that the vibration absorbing means includes at least one of a spring member, a rubber member formed of a rubber, a gel member formed of a gel material and a bellows (an eighth arrangement).

Each of the vacuum pumps of the sixth to eighth arrangements can be constructed such that: the flange portion is discrete from the outer cylindrical portion; and the vibration absorbing means is disposed at the joint portion connecting the flange portion and the outer cylindrical portion (a ninth arrangement).

In the vacuum pump of the ninth arrangement, the vibrations propagated to the outer cylindrical portion, including the vibrations of the motor and the bearing caused within the vacuum pump when the rotor portion is rotated and the vibrations due to an external factor such as a vibration propagated from a back pump, are all reduced by the vibration absorbing means, and then propagated to the external container. Accordingly, it is possible to remarkably reduce the vibrations on the external container.

The vacuum pump of the ninth arrangement can be constructed as a vacuum pump comprising: an outer cylindrical portion defining a hollow portion accommodating therein a stator portion and a rotor portion rotatable with respect to the stator portion; a cylindrical flange portion discrete from the outer cylindrical portion and having an inlet port for a gas contained within an external container; elastic supporting means, fixed to the outer cylindrical portion, for elastically displaceably supporting the flange portion with respect to the outer cylindrical portion; a communicating member communicating the inlet port of the flange portion with the hollow portion of the outer cylindrical portion; and a motor for rotating the rotor portion with respect to the stator portion to suck the gas contained within the external container from the inlet port of the flange portion through the communicating member to the hollow portion of the outer cylindrical portion. That is, the vacuum pump is provided with the elastic supporting means serving as the vibration absorbing means for reducing the propagation of the vibration from the outer cylindrical portion to the external container. Accordingly, the required space in the axial direction is not increased in comparison to a solution in a related art in which vibration absorbing means such as a damper is disposed between the flange integral with the outer cylindrical portion and the external container. By arranging the elastic supporting means on the outer circumferential surface of the outer cylindrical portion, the space in the axial direction can further be made small.

In the vacuum pump of the ninth arrangement, the vibration absorbing means can also be used as the communicating member communicating the inlet port of the flange portion with the hollow portion of the outer cylindrical portion. In this case, if the vibration absorbing means is directly fixed to the circumferential surface of the outer cylindrical portion, a hermetical sealing state must be established between the outer cylindrical portion and the elastic supporting means. If the vibration absorbing means is fixed with respect to the outer cylindrical portion through an additional member, the hermetical sealing state must be established between the additional member and the outer cylindrical portion and between the additional member and the vibration absorbing means.

In the vacuum pump of the ninth arrangement, the vibration absorbing means may include an elastic member connecting the outer circumference of the outer cylindrical portion to the flange portion, and a bellows juxtaposed to the elastic member to connect the outer circumference of the outer cylindrical portion to the flange portion. In this vacuum pump, if the vacuum pump is activated to reduce the internal pressure in the outer cylindrical portion, the bellows contracts in the axial direction. The bellows also contracts together with the elastic member depending on the displacement of the flange portion with respect to the outer cylindrical portion due to the vibrations and the like. This makes it possible to define a gas passage that extends from the flange portion to the outer cylindrical portion and that is hermetically sealed from the exterior, thereby eliminating the mixture of other members and exterior gas outside the bellows into the vacuum pump. In this case, it is preferable to dispose the elastic member outside the bellows, because molecular contained in the elastic member can be surely prevented from mixing and entering into the vacuum pump by the bellows. It is preferable that a spring constant of the bellows in the axial direction is smaller than that of the elastic member in the axial direction. This makes it possible to prevent the breakage of the bellows even in the case where the pressure within the outer cylindrical portion is increased or decreased or an external impact is applied.

The vacuum pump of the ninth arrangement can have restricting means for restricting a position of the flange portion to a predetermined range with respect to the outer cylindrical portion (a tenth arrangement).

In the vacuum pump of the tenth arrangement, the restricting means restricts the position of the flange portion to the predetermined range with respect to the outer cylindrical portion. Accordingly, even if the large impact such as the breakage of the rotor portion occurs, the elastic member and the bellows are protected from being broken, which, in turn, lowers a possibility of an accident in which the vacuum pump is removed from the external container or the pipe connected to the external container. Thus, the high safety can be ensured.

The present invention achieves the second object by providing the vacuum pump of each of the fifth to tenth arrangements, which further comprises a sheet-like magnetic shielding material that is disposed radially outwardly at the stator portion and the rotor portion to circumscribe the stator portion and the rotor portion, and that is disposed along an inner circumferential surface of the outer cylindrical portion (an eleventh arrangement).

In the vacuum pump of the eleventh arrangement, the magnetic shielding material is disposed outwardly of the stator portion and the rotor portion to avoid the external leakage of the magnetic fluxes caused by electromagnets, permanent magnets and the like. constructing the motor and the magnetic bearing. This magnetic shielding material is disposed outwardly of the stator portion and the rotor portion and separated predetermined distances from the electromagnets and permanent magnets that generate the magnetic fluxes. Accordingly, the magnetic shielding material can effectively eliminate the leakage of the magnetic fluxes with a reduced thickness thereof, and thus the cost of the magnetic shielding material and the installation space therefor can be suppressed. Since the magnetic shielding material is disposed inwardly of the outer cylindrical portion, it is protected by the outer cylindrical portion and less likely to be damaged.

The present invention achieves the third object by providing the vacuum pump of each of the fifth to eleventh arrangements, which further comprises: an insulative portion formed of an electrically high-insulative resistance material, which is disposed at the joint portion connecting the outer cylindrical portion and the flange portion (a twelfth arrangement)

DETAILED DESCRIPTION OF THE PREFERRED EMBODIMENTS

A preferred embodiment of the present invention will be described in detail with reference to FIGS. 1 to 3C.

Figure 1:
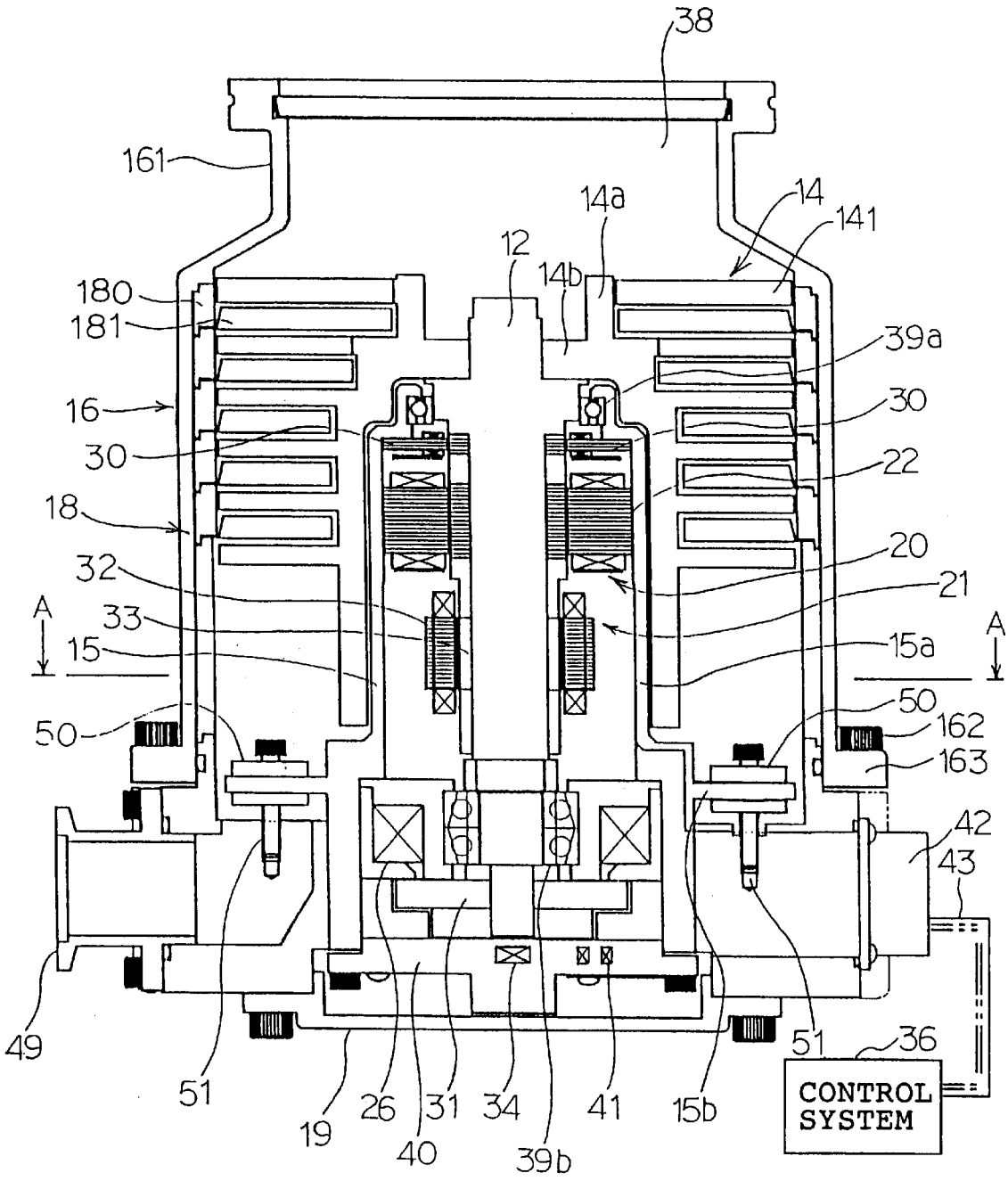
FIG. 1 is a sectional view showing the entire arrangement of a turbo-molecular pump which constitutes a first embodiment of a vacuum pump according to the present invention.

FIG. 1 is a sectional view showing the entire arrangement of a turbo-molecular pump, which constitutes an embodiment (a first embodiment) of a vacuum pump according to the present invention.

As shown in FIG. 1, the vacuum pump (the turbo-molecular pump) according to the first embodiment includes: a casing 16, serving as an outer cylindrical portion, which is to be connected to an outer container (not shown) and that has an inlet port 38 for sucking gas contained within the external container; a rotor shaft 12 and a rotor body 14, serving as a rotor portion, which are rotatably accommodated within a hollow portion of the casing 16; a stator body 18 and a stator shaft 15, serving as a stator portion, which are disposed within the hollow portion of the casing 16 coaxially with respect to the rotor shaft 12 and the rotor body 14 and which transfer the gas sucked from the inlet portion 38 in cooperation with the rotor body 14; and a base 19 for supporting the casing 16, the stator body 18 and the stator shaft 15.

The casing 16 has a flange 161 to be fixed to the external container so that the inlet portion 38 formed inside the flange 161 is connected to an outlet port of the external container for communication between the interior of the external container and the interior of the casing 16.

An end portion 163 of the casing 16, opposite from the flange 161, is threadingly fixed to the base 19 with bolts 162.

The rotor shaft 12 is located inwardly of the stator shaft 15, and supported rotatably such that one end portion (an upper portion) thereof is exposed upwardly from the interior of the stator shaft 15. A magnet or magnets 33, serving as a driven part of a motor, are fixed to the substantially central portion of the rotor shaft 12 in the axial direction.

The rotor body 14 has a substantially cylindrical, circumferential wall portion 14*a* disposed to circumscribe the outer circumference of the stator shaft 15, a support portion 14*b* for closing a hollow portion of the circumferential wall portion 14*a*, and rotor blades 141 attached to the outer circumference of the circumferential wall portion 14*a*. The support portion 14*b* is fixed to the upper portion of the rotor shaft 12 exposed from the stator shaft 15 so as to be rotated together with the rotor shaft 12.

The rotor blades 141 are arranged as multiple stages in the axial direction onto the circumferential wall portion 14*a*, and each of the rotor blades 141 is formed with a plurality of radially protruded blades (fans). Each of the fans is inclined at a predetermined angle such that the inlet portion 38 side (the upper side in the drawing) is the rotational direction side and each fan collides against the gas molecular to be moved downwardly.

The stator body 18 has spacers 180, and stator blades 181, each of which is supported at its outer circumferential side by and between respective adjacent spacers 180 to be disposed between respective adjacent stages of the rotor blades 141.

The spacers 180, each in the form of a cylinder having a stepped portion, are stacked one on another in the interior of the casing 16.

The stator blade 181 includes an outer annular portion partially clamped by and between the spacers 180 in the circumferential direction, an inner annular portion disposed inwardly of and coaxially to the outer annular portion, and a plurality of stator blades radial ends of which are respectively supported by the outer and inner annular portions with a predetermined angle. The inner diameter of the inner annular portion is larger than the outer diameter of the circumferential wall portion 14*a*, so that the inner circumferential surface of the inner annular portion is confronted with the outer circumferential surface of the circumferential wall portion 14*a* with a clearance therebetween.

The stator blade 181 is circumferentially divided into two parts in order that the stator blade 181 is disposed between the rotor blades 141 of the adjacent stages. The stator blade 181 is formed by preparing a thin plate, made, for instance, of stainless steel or aluminum steel, and divided into two parts, cutting out or separating from each part a member having a semi-circular outer diameter portion and portions corresponding to the fans of the stator blade through an etching process or the like, and bending the portions corresponding to the fans of the stator blade to have a predetermined angle through a pressing process.

Each of the stator blade 181 is clamped at its outer annular portion by and between the adjacent spacers 180 so as to be held between the rotor blades 141.

The stator shaft 15 is provided with a cylindrical portion 15*a* disposed coaxially to the rotor shaft 12, and a fixed portion (a protruded portion) 15*b* arranged on the outer circumferential wall of the cylindrical portion 15*a*.

The cylindrical portion 15*a* is disposed between the circumferential wall portion 14*a* of the rotor body 14 and the rotor shaft 12. A coil or coils 32, serving as a driving part of the motor, are fixed to the inner circumferential wall of the cylindrical portion 15*a* so as to be confronted with the magnet or magnets 33. Consequently, the coil(s) 32, through which current flows, urges the magnet(s) 33 to rotate the rotor shaft 12.

The fixed portion 15*b* is extendingly provided such that it is radially protruded from the outer circumferential wall of the cylindrical portion 15*a*, and extends over and is separated from the ceiling surface of the base 19.

Figure 2:
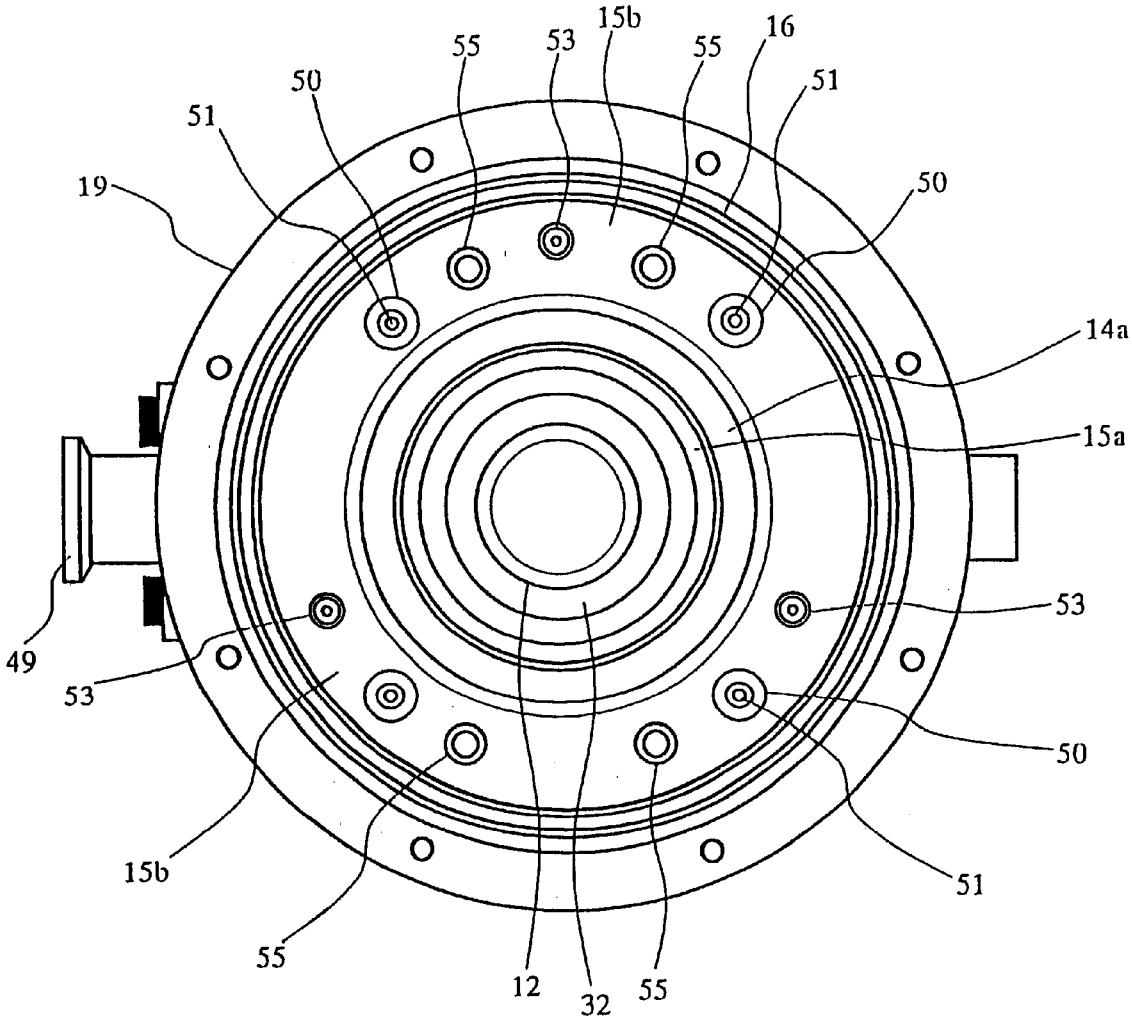
FIG. 2 is a radial sectional view, taken along an arrow line A—A in FIG. 1, showing a fixed portion of a stator shaft in the turbo-molecular pump shown in FIG. 1.
Figure 3A:
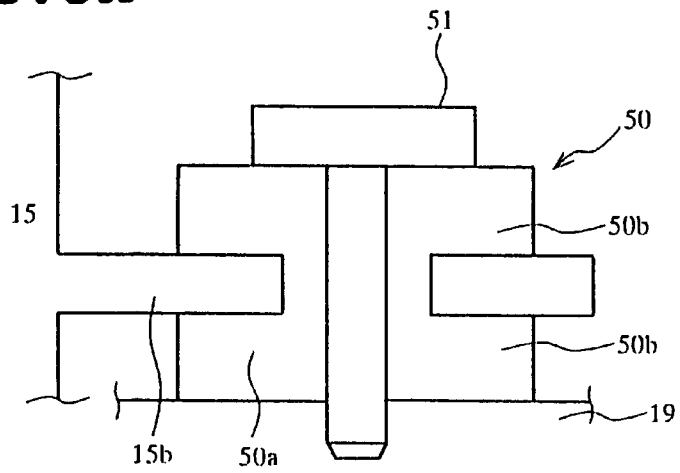
FIGS. 3A, 3B and 3C are axial sectional views showing major portions of a fixed portion 15*b* of the turbo-molecular pump shown in FIG. 1.
Figure 3B:
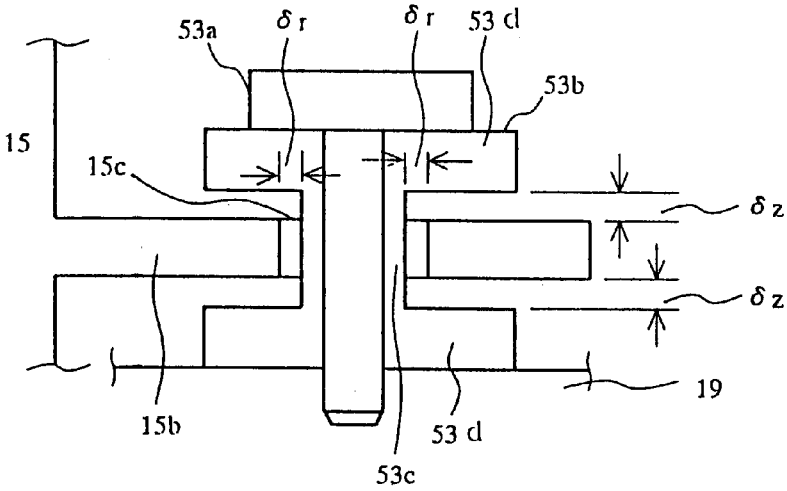
Figure 3C:
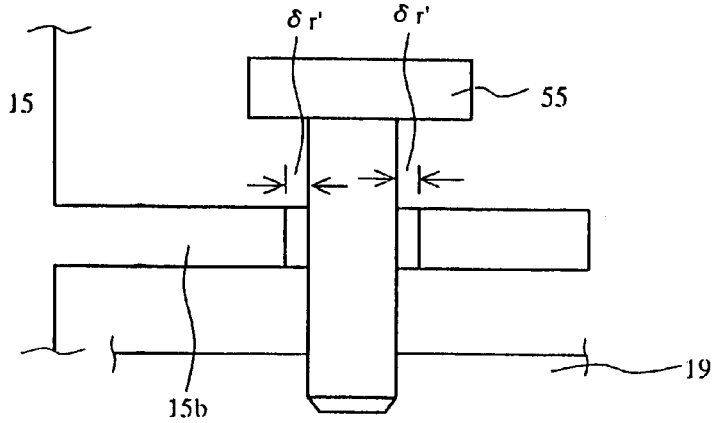
Figure 4:
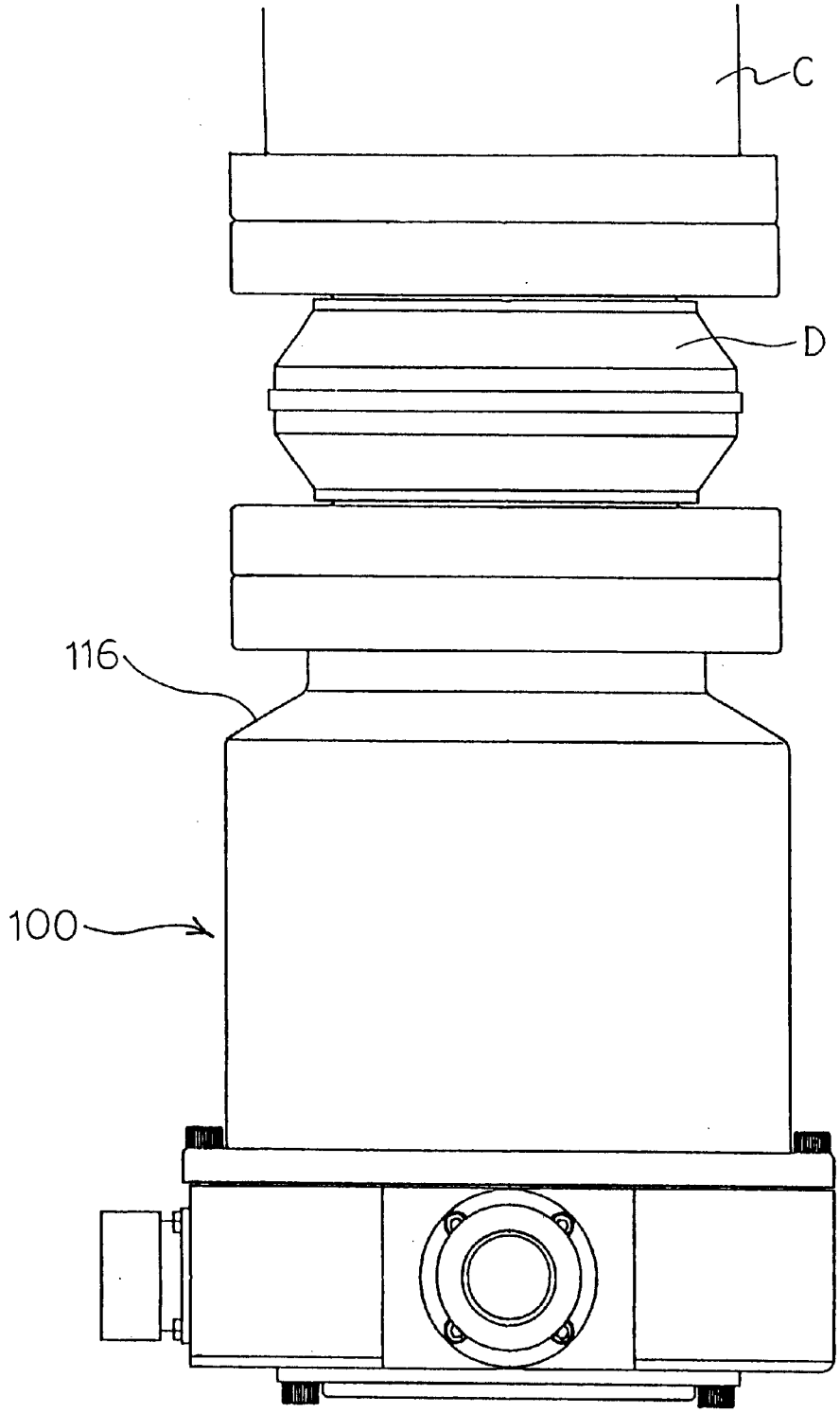
FIG. 4 is an explanatory view showing a state in which a related vacuum pump is used.

FIG. 2 is a radially sectional view showing the fixed portion 15*b* of the stator shaft 15, which is taken along an arrow line A—A of FIG. 1. FIGS. 3A to 3C are axial sectional views showing major portions of the fixed portion 15*b*. FIG. 3A is a sectional view at a location where a fixing hole is arranged, FIG. 3B is a sectional view at a location where a first guide hole is arranged, and FIG. 3C is a sectional view at a location where a second guide hole is arranged.

The fixed portion 15*b* is formed with fixing holes at four locations evenly distributed in the circumferential direction. As also shown in FIG. 2, bolts 51 are loosely inserted in the fixing holes, respectively. Each leading end of the fixing bolts 51 is threadingly engaged with and thus fixed to the base 19 as shown in FIG. 3A. A damper 50 is mounted onto and around each of the fixing bolts 51 as a vibration absorbing member.

The damper 50 is made of a silicon gel material to have a cylindrical portion 50*a* and two circular disk portions 50*b* equidistantly extended radially from the respective end portions of the cylindrical portion 50*a*. The cylindrical portion 50*a* is inserted into the fixing hole of the fixed portion 15*b* to fill a space between the fixing hole circumferential surface of the fixed portion 15*b* and the fixing bolt 51. The circular disk portions 50*b* of the damper 50 respectively fill a space between the fixed portion 15*b* and the bolt head and a space between the fixed portion 15*b* and the base 19.

The fixed portion 15*b* is formed with first guide holes (restricting holes) 15*c* at three locations evenly distributed in the circumferential direction, and second guide holes at four locations which do not overlap the locations where the fixing holes and the first guide holes are provided. As shown in FIG. 2, a first guide member 53, serving as a displacement restricting member, is mounted to each of the first guide holes. Further, a second guide member 55, serving as a reinforcing member for receiving a rotational torque in the case where the rotor portion is locked, is mounted to each of the second guide holes.

As shown in FIG. 3B, the first guide member 53 includes a restricting bolt 53*a*, the leading end of which is fixed to the ceiling surface of the base 19, and a restricting member 53*b* fixed to the shaft of the restricting bolt 53*a*. The restricting member 53*b* has a restricting cylinder 53*c* mounted to the shaft of the restricting bolt 53*a*, and two flange portions (plate portions) 53*d* equidistantly extended radially from the respective end portions of the restricting cylinder 53*c*. The restricting cylinder 53*c* is loosely inserted into the first guide hole 15*c* of the fixed portion 15*b* so that the outer circumferential surface of the restricting cylinder 53*c* is separated from the inner circumferential surface of the first guide hole 15*c* of the fixed portion 15*b* with a minute clearance δr. Each of the flange portions 53*d* is spaced from a surface of the fixed portion 15*b* with a minute clearance δz.

With this arrangement, the first guide hole 15*c* is brought into contact with the restricting member 53*b* to restrict the displacement of the restricting member 53*b*. Consequently, the displacement of the stator shaft 15 with respect to the base 19 is restricted so that the stator shaft 15 can be displaced only δz in each of the upward and downward directions vertically (axial direction) and δr in each of the inward and outward directions radially.

As shown in FIG. 3C, the second guide member 55 is constructed as a bolt having a threading portion larger in outer diameter than that of the restricting bolt 53*a*. The shaft of the second guide member 55 is loosely inserted into the second guide hole, and the leading end thereof is fixed to the ceiling surface of the base 19 in a state that a minute clearance δr' is defined between the shaft of the second guide member 55 and the inner circumferential surface of the second guide hole. The clearance δr' between the shaft of the second guide member 55 and the inner circumferential surface of the second guide hole is smaller than the clearance δr between the shaft of the fixing bolt 53*a* and the inner circumferential surface of the first guide hole. For this reason, the stator shaft 15 can be displaced only δr' in each of the inward and outward directions radially with respect to the base 19. Accordingly, the second guide member 55 is designed to serve commonly as the reinforcing member for receiving the rotational torque in the case where the rotor portion is locked, and as the displacement restricting member. Therefore, the displacement of the stator shaft 15 with respect to the base 19 is restricted by the first guide members 53 and the second guide members 55 so that the stator shaft 15 can be displaced only δz in each of the upward and downward directions vertically (axial direction), δr' in each of the inward and outward directions radially, and δr' in each of the forward and reverse directions circumferentially.

The base 19 shown in FIG. 1 is disposed with an outlet port 49, from which the gas transferred between the rotor blades 141 and the stator blades 181 is discharged externally. As shown in FIG. 1, the base 19 is formed with a circuit board accommodating portion 40 for accommodating a circuit board therein. In the circuit board accommodating portion 40, a rotational speed sensor 41 for detecting a rotational speed of the rotor shaft 12 and other components are installed. The base 19 is equipped with a connector 42, so that a signal from the rotational speed sensor 41 is transmitted to a control system 36 connected thereto through a cable 43. Based on this signal, the control system 36 controls the rotation of the rotor shaft 12.

The turbo-molecular pump of this embodiment is further provided with a magnetic bearing 20 for supporting the rotor shaft 12 through a magnetic force.

The magnetic bearing 20 is designed as three axes controlled magnetic bearing, and has a radial electromagnet 22 for applying a radial magnetic force to the rotor shaft 12, a radial sensor 30 for detecting a radial positional displacement of the rotor shaft 12, an axial electromagnet 26 for applying an axial magnetic force to the rotor shaft 12, a metal disk 31 on which the axial force by the axial electromagnet 26 acts, and an axial sensor 34, disposed inside the circuit board accommodating portion 40, for detecting an axial displacement of the rotor shaft 12.

The radial electromagnet 22 includes two pairs of electromagnets (one pair is only shown in the drawing) that are fixedly disposed on the inner circumferential surface of the stator shaft 15 to be orthogonal to the other pair. The electromagnets in each pair are disposed at the upper portion of the rotor shaft 12 above a motor 21, and confronted with each other through the rotor shaft 12 located therebetween.

Above the radial electromagnets 22, two pairs of radial sensors 30 (one pair is only shown in the drawing) are provided such that the radial sensors 30 in each pair are confronted with each other through the rotor shaft 12 located therebetween. The two pair of the radial sensors 30 are disposed such that one pair is orthogonal to the other pair, correspondingly to the two pairs of the radial electromagnets 22.

By supplying exciting current to the radial electromagnet 22, the rotor shaft 12 is magnetically floated. During the magnetic floating, this exciting current is controlled based on the displacement detection signals from the radial sensors 30 so that the rotor shaft 12 is held at a predetermined position radially.

The circular, metal disk 31 formed of magnetic material is fixed to the lower portion of the rotor shaft 12. Above the metal disk 31, the axial electromagnet 26 is fixedly disposed on the base 19. An axial sensor 34 is disposed within the circuit board accommodating portion 40 to be confronted with the lower end portion of the rotor shaft 12 to thereby detect the axial position of the rotor shaft 12.

The exciting current to the axial electromagnet 26 is controlled based on the displacement detection signal from the axial sensor 34 so that the rotor shaft 12 is held at a predetermined position axially.

The magnetic bearing 20 is provided with magnetic bearing control means which magnetically floats the rotor shaft 12 by feed-back control of exciting currents to the radial electromagnet 22 and the axial electromagnet 26 based on the detection signals from the radial sensor 30 and the axial sensor 34, and which is installed within the control system 36 connected through the connector 42 disposed on the base 19 and the cable 43.

Since this magnetic bearing can hold the rotor shaft 12 at the predetermined position, the rotor portion (the rotor shaft 12 and the rotor body 14) is unlikely to be mechanically contacted with the stator shaft 15 and the stator body 18, thereby suppressing the generation of particles. Further, the use of this magnetic bearing can dispense with sealing oil or the like, thereby eliminating the generation of gas. Accordingly, the rotational driving of the rotor portion under a clean environment can be realized. For this reason, the turbo-molecular pump using the magnetic bearing is suitable for the case where high cleanness is required, such as the manufacture of the semiconductor devices.

In the turbo-molecular pump of this embodiment, touch down bearings 39*a* and 39*b* are respectively disposed at the upper and lower portions of the rotor shaft 12.

Normally, the rotor shaft 12 and the components mounted thereto to form the rotor body 14 are supported in a non-contact state by the magnetic bearing 20 during the rotation. The touch down bearings 39*a* and 39*b* serve as protective bearings for the entire apparatus, which support the rotor portion in place of the magnetic bearing 20 when the touch down occurs.

Therefore, each of the touch down bearings 39*a* and 39*b* is disposed such that the inner race thereof is in non-contact state with the rotor shaft 12.

In the turbo-molecular pump of this embodiment as constructed above, when the rotor shaft 12 is rotated, the rotation of the rotor shaft 12 is transmitted to the rotor body 14 to rotate the rotor body 14 at a high speed of a rated value (20,000 to 50,000 rpm) and thus rotate the rotor blades 141 at the high speed. This allows the gas from the inlet port 38 to be transferred by the rotor blades 141 and discharged from the outlet port 49.

During the rotational driving of the turbo-molecular pump, the vibrations are caused by the cogging of the rotating magnetic field due to the motor coil energized. Further, the rotor shaft 12 and the rotor body 14 may be vibrated due to the procession and nutation in a conical mode at the start and stoppage. The vibrations on the rotor shaft 12 are generally corrected by the magnetic bearing 20. However, if the rotor balance is not good and the rotational shift is increased, the magnetic bearing attempts to suppress the rotational shift, causing a large control reaction acting on the stator.

In this case, since the stator shaft 15 is fixed to the base 19 with a clearance therebetween, the vibrations are transmitted to the base 19 only through the damper 50 interposed between the stator shaft 15 and the base 19. When the stator shaft 15 is vibrated at a boundary to the damper 50, the damper 50 is elastically deformed depending on the vibrations, and the displacement of the stator shaft 15 is not propagated to the base 19. That is, the vibrations are absorbed by the damper 50 to reduce the propagation of the vibrations. Accordingly, the base 19 is hardly affected by the vibrations, and is held under a stationary state.

If the stator shaft 15 attempts to be displaced an amount larger than $\delta z$ axially at the boundary to the damper 50, the fixed portion 15*b* of the stator shaft 15 is brought into contact with the flange portion 53*d* of the first guide member 53, thereby restricting the axial displacement of the stator shaft 15. If the stator shaft 15 attempts to be displaced an amount larger than $\delta r'$ radially at the boundary to the damper 50, the fixed portion 15*b* of the stator shaft 15 is brought into contact with the second guide member 55, thereby restricting the radial displacement of the stator shaft 15.

As described above, in the turbo-molecular pump of this embodiment, the damper 50 is interposed, as a vibration absorbing member, between the fixed portion 15*b* of the stator shaft 15 and the base 19 to displaceably support the stator shaft 15 with respect to the base 19. Therefore, the vibrations caused by the coil 32 of the motor and the magnetic bearing are absorbed and attenuated by the damper 50 from the stator shaft 15, and then propagated to the base 19 and the external container. Consequently, according to this embodiment, it is possible to suppress the propagation of the vibrations to the external container. Since it is unnecessary to add a damper or the like which is required in the related apparatus to be interposed between the outer cylinder portion 16 and the external container, the propagation of the vibrations can be suppressed in a space-saving fashion. Further, since it is unnecessary to mount and remove the damper during operation, the increase in labor and cost, non-stability in gas sucking performance, and lowering of durability, which are associated with the use of the damper or the like, can be eliminated.

In this embodiment, as the vibration absorbing member (the damper 50), one having a natural frequency F meeting the following formula is used:

$$F=(f1+f3)/2\pm(f1-f3)/4$$

where the natural frequencies of the magnetic bearing are represented by f1, f2 and f3.

Accordingly, the natural frequencies can be set not to be close to the natural frequency of the damper 50. Therefore, according to this embodiment, the rotational shift of the rotor shaft 12 is difficult to be increased with respect to the external force such as an earthquake, and the rotor shaft 12 and the rotor body 14 can be supported stably with respect to the stator shaft 15 and the stator body 18.

In this embodiment, as the vibration absorbing member (the damper 50), one that is made of silicon gel is used, and therefore the rate of the vibrations propagation, especially from the low frequency, can be reduced one or more orders, and it is possible to remarkably suppress the propagation of the vibrations.

According to this embodiment, the first guide member 53 and the second guide member 55, serving as the displacement restricting means, restrict the displacement of the stator shaft 15 with respect to the base 19, and the stator shaft 15 can be displaced only δz in each of the upward and downward directions vertically (axial direction), and δr' in each of the inward and outward directions radially. Even in the case where the external force may acts due to an earthquake or other factors, the stator shaft 15 is not largely inclined or displaced with respect to the base 19, eliminating the contact damage between components such as the contact of the stator blades 181 with the rotor blades 141 to damage the latter.

Incidentally, the vacuum pump according to the present invention should not be limited to the aforementioned embodiment, and can be modified in various manners without departing from the spirit and scope of the present invention.

For example, although the damper 50, serving as the vibration absorbing member, is interposed between the stator shaft 15 and the base 19 in the first embodiment described above, the damper 50 may be disposed between the outer cylindrical portion 16 and the base 19, not between the stator shaft 15 and the base 19. In the modification in which the damper 50 is interposed between the outer cylindrical portion 16 and the base 19, the vibrations propagated to the base are all attenuated by the vibration absorbing member. Therefore, even if the vibrations are propagated thereto from an external device such as a back pump, the propagated vibrations are attenuated and then propagated to the outer cylindrical portion 16. Accordingly, the vibrations other than the vibrations on the stator shaft 15 can be attenuated.

In the first embodiment and the modification described above, the dampers 50, serving as the vibration absorbing member, are disposed at a plurality of locations evenly distributed circumferentially between the fixed portion 15*b* of the stator shaft 15 and the base 19. However, the vibration absorbing member may be interposed entirely between the fixed portion 15*b* and the base 19.

In the first embodiment and the modifications described above, the damper 50, serving as the vibration absorbing member, is made of a silicon gel, but it should not be limited thereto. For example, the damper 50 used may be made of a silicon rubber, a vibration preventive alloy, an O-ring, a spring, or the like. Further, it may be made of such a material in which a fluorine coating is laminated on the silicon gel material. Since an acrylic coating has an excellent heat resistive property, the coating is difficult to be thermally damaged by the motor coil 32 or by the frictional heat caused due to the rotation of the rotor blades 141 or other rotor portions, thereby providing an excellent durability.

In the first embodiment and the modifications described above, the rotor blades 141 are protruded outwardly from the outer circumferential surface of the circumferential wall portion 14*a*. However, the rotor blades may be protruded inwardly from the inner circumferential surface of the circumferential wall portion 14*a*, and the stator body 18 may be disposed radially inwardly of the rotor body 14.

Further, in the first embodiment and the modifications described above, the rotor shaft 12 is supported by the magnetic bearing, but the present invention should not be limited thereto. The rotor shaft 12 may be supported by a dynamic pressure bearing, a static pressure bearing or any other bearing.

In the first embodiment and the modifications described above, the vacuum pump is constructed as the turbo-molecular pump having the rotor blades 141 and the stator blade 181. The vacuum pump may be constructed as a thread groove-type pump in which a thread groove is arranged in the rotor body 14 or the stator body 18 in order to transfer the gas using the viscosity of the gas when the rotor portion is rotated, or may be constructed as a composite pump in which the turbo-molecular pump is combined with the thread groove-type pump.

Next, another preferred embodiment of the present invention will be described in detail with reference to FIGS. 5 to 7.

Figure 5:
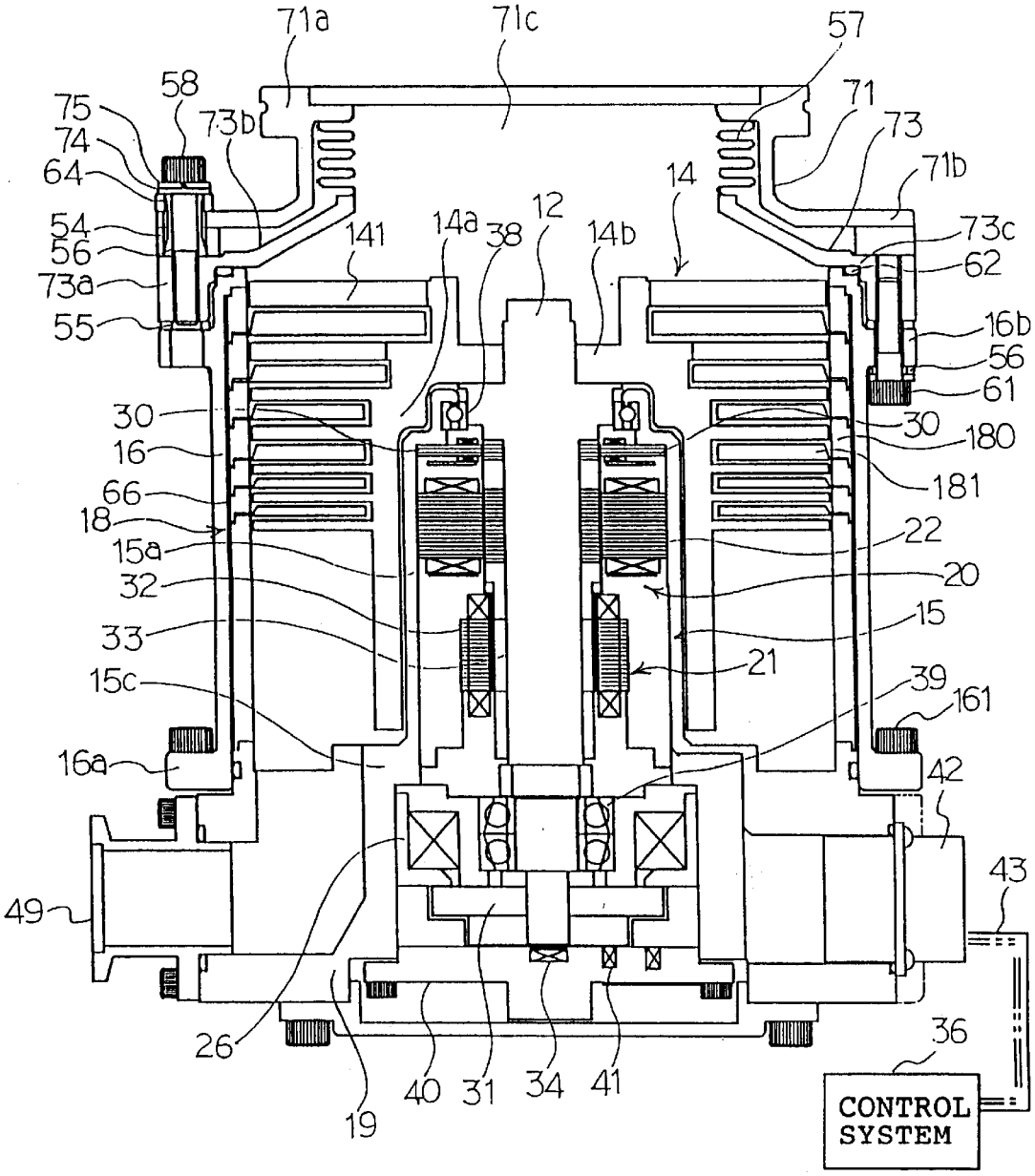
FIG. 5 is an axial sectional view showing the entire arrangement of a turbo-molecular pump which constitutes a second embodiment of the vacuum pump according to the present invention.

FIG. 5 is an axial sectional view showing the entire arrangement of a turbo-molecular pump, which constitutes an embodiment (a second embodiment) of the vacuum pump according to the present invention.

As shown in FIG. 5, the embodiment of the vacuum pump (the turbo-molecular pump) includes: a flange member 71, serving as a flange portion, which is to be connected to an external container and which is formed with an inlet port 71*c* for sucking the gas contained within the external container; an outer cylindrical member 16, serving as an outer cylindrical portion, one end side of which is connected to the flange member 71; a base 19 which is connected to the other end side of the outer cylindrical member 16 and which defines, in cooperation with the flange member 71 and the outer cylindrical member 16, a hollow portion to be communicated with the interior of the external container through the inlet port 71*c*; a stator shaft 15 and a stator body 18, serving as a stator portion, which are supported by the base 19 to be accommodated within the hollow portion; and a rotor shaft 12 and a rotor body 14, serving as the rotor portion, which are accommodated within the hollow portion. The stator shaft 15 and the base 19 are formed integrally, and the outer cylindrical member 16 is fixedly supported by the base 19.

A magnetic bearing 20 is provided, which rotatably supports the rotor shaft 12 and the rotor body 14 with respect to the stator shaft 15 and the stator body 18. A motor 21 is provided, which rotates the rotor shaft 12 and the rotor body 14 supported by the magnetic bearing 20 with respect to the stator shaft 15 and the stator body 18.

In the turbo-molecular pump of this embodiment, an elastic and/or viscous member 54 and a bellows 57, serving as vibration absorbing means containing a vibration absorbing material, and a supporting member 73 for supporting the vibration absorbing means, are disposed at a joint portion connecting between the flange member 71 and the outer cylindrical member 16. The elasticity and/or viscosity of the vibration absorbing means attenuates the vibrations propagated.

Describing this embodiment in detail, an outlet port 49, serving as an outlet port for discharging the gas contained in the hollow portion, is attached to the base 19. The elastic and/or viscous member 54 is a rubber member made of a rubber.

The flange member 71 is formed as a separate member from the outer cylindrical portion 16, and the supporting member 73, the elastic and/or viscous member 54 serving as the vibration absorbing means, and the bellows 57 are disposed at the joint portion connecting the flange member 71 and the outer cylindrical member 16. The flange member 71 and the cylindrical member 16 are connected together through the supporting member 73, the elastic and/or viscous member 54 and the bellows 57.

Further, this embodiment is provided, as restricting means for restricting a position of the flange member 71 to a predetermined range with respect to the outer cylindrical member 16, a restricting screw 58 fixedly threaded into the supporting member 73, and a collar 59 that is mounted around the shaft of the restricting screw 58 and that is located between the head of the threading screw 58 and the supporting member 73.

The stator body 18 and the rotor body 14 are circumscribed by a sheet-like magnetic shielding member 66 disposed radially outwardly thereof. The magnetic shielding member 66 is disposed along the inner circumferetial surface of the outer cylindrical member 16.

Hereafter, a further detailed description of this embodiment will be given.

The outer cylindrical member 16 is made of stainless steel, and configurated to have a base fixing portion 16*a* and a flange member supporting portion 16*b*, each being protruded radially outwardly from a circumference of a respective, different end portion of a hollow cylinder. The base fixing portion 16*a* is fixed to the base 19 with screws.

Figure 6:
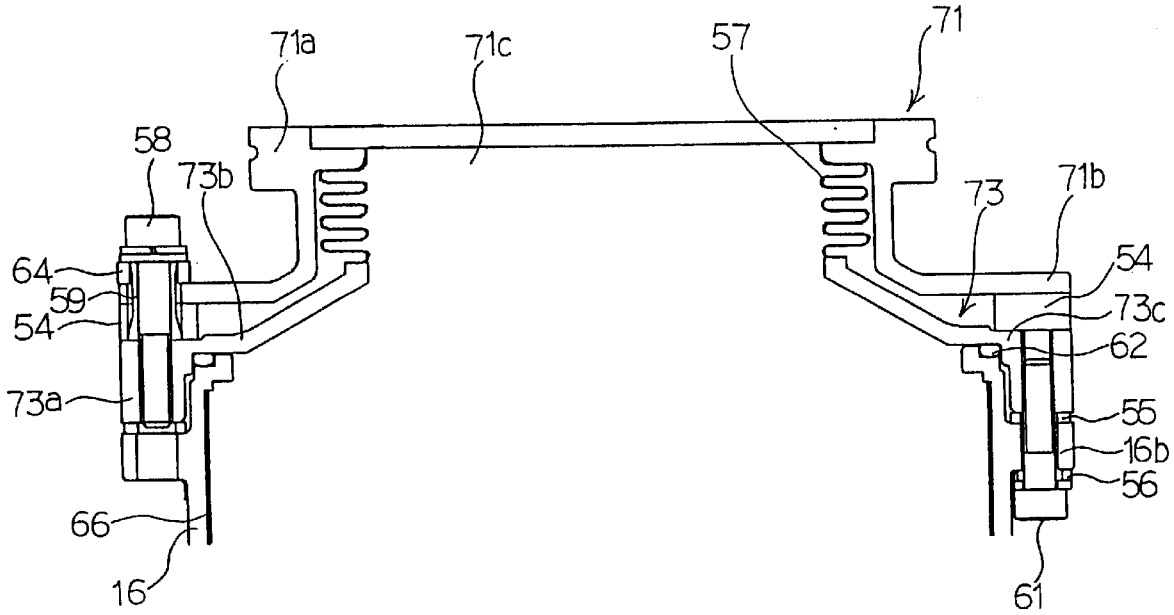
FIG. 6 is an enlarged, axial sectional view showing major portions of vibrations and electric noise propagation reducing structure in a flange member of the turbo-molecular pump shown in FIG. 5.

FIG. 6 is an axial sectional view showing major portions including the flange member 71.

As also shown in FIG. 6, the flange member 71 is made of a material the same as or similar to the material (stainless steel) of the outer cylindrical member 16, and the circumference of one end portion in a cylinder form is protruded radially outwardly to serve as a mounting portion 71*a*. This mounting portion 71*a* is fixed to the circumferential portion of the outlet portion of the external container. The circumference of the other end portion is formed into a supported portion 71*b*. The supported portion 71*b* is located between the mounting portion 71*a* and the outer cylindrical member 16 and above the flange member supporting portion 16*b* (the external container side) of the outer cylindrical member 16 in the axial direction of the rotor member and the outer cylindrical member 16.

A peripheral end portion of an elongating portion 73*b* of the supporting member 73 is disposed below an outlet portion 71*c* peripheral end portion of the flange member 71 (i.e. in a base side in the axial direction of the rotor member), and a passage hole is formed, which is circumscribed by the peripheral end portion of the elongated portion 73*b*. This passage hole is substantially the same in size as the outlet port 71*c* of the flange member 71.

A support fixing portion 73*a* of the supporting member 73 is in the form of a cylinder, and placed on the upper portion of the flange member supporting portion 16*b* of the outer cylindrical member 16 through a first insulative sheet 55 serving as an insulative portion. The support fixing portion 73*a* is formed with axial threading holes at plural locations circumferentially, and the first insulative sheet 55 is formed with through-holes corresponding in location to the threading holes. Short screws 61, through the through-holes formed in the first insulative sheet 55 without being contacted with the flange member supporting portion 16*b*, are threadingly engaged with and fixed to threading holes perforated through the support fixing portion 73*a*. A second insulative sheet 56 is interposed between the head of each short screw 61 and the flange member supporting portion 16*b*. With this arrangement, the short screw 61 is threadingly engaged with the supporting member 73 while being electrically insulated from the outer cylindrical member 16, thereby fixing the support fixing portion 73*a* of the support member 73 to the flange member support portion 16*b* of the outer cylindrical member 16.

One end surface of the support fixing portion 73*a*, opposite from the flange member supporting portion 16*b*, is confronted with the supported portion 71*b* of the flange member 71 over the entire circumference thereof. The ring-like elastic and viscous member 54 is clamped between the support fixing portion 73*a* and the supported portion 71*b* of the flange member 71. As the elastic and viscous member 54, a silicon rubber or the like can be used.

The support fixing portion 73*a* of the supporting member 73 is formed with threading holes for threading engagement with the restricting screws, and each of the elastic and viscous member 54 and the supported portion 71*b* of the flange member 71 is formed with holes at locations corresponding to the locations (the circumferentially same locations) where the threading holes are formed in the support fixing portion 73*a*. The holes are larger in diameter than the threading holes. A plurality of ring-shaped supplemental elastic and viscous members 64 are disposed on the upper portion of the supported portion 71*b* of the flange member 71, so that a hole of each supplemental elastic and viscous member 64 is aligned with associated holes of the elastic and viscous member 54 and the supported member 71*b* of the flange member 71.

Stainless steel made, cylindrical collars 59 are provided, each being loosely inserted into the insides of the associated holes of the supplemental elastic and viscous member 64, the supported portion 71*b* of the flange member 71 and the elastic and viscous member 54.

Figure 7:
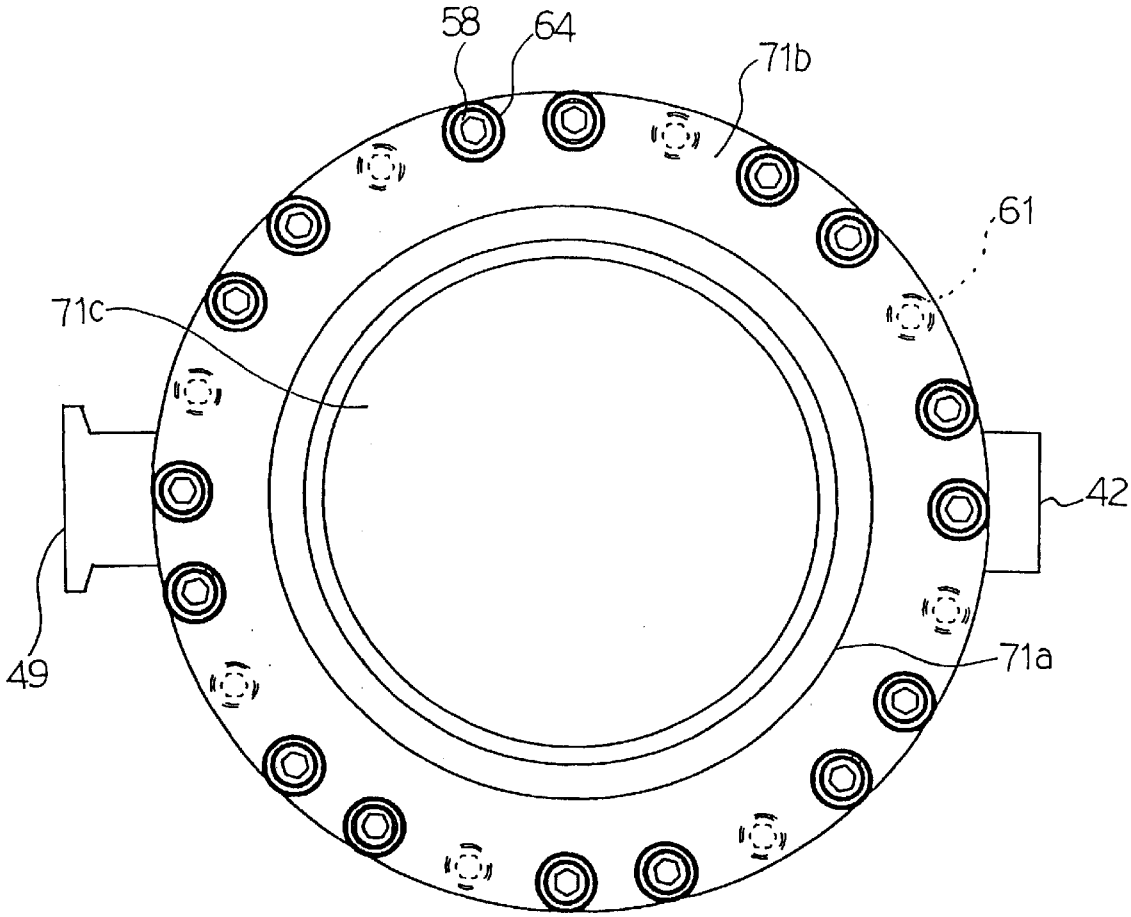
FIG. 7 is a plane view showing the turbo-molecular pump shown in FIG. 5, as viewed from an inlet port side thereof.

FIG. 7 is a plane view showing the turbo-molecular pump of this embodiment, as viewed from the inlet port 71 side thereof.

As also shown in FIG. 7, the restricting screw 58 is threadingly inserted into the threading hole of the support fixing portion 73*a* of the support member 73 while being passed through the collar 59 downwardly. As shown in FIG. 6, the screw head is contacted through a spring washer 75 and a planar washer 74 with the collar 59, such that the amount by which the restricting screw 58 is threadingly inserted is restricted. A distance between the planar washer 74 and the support fixing portion 73*a* is secured by the axial length of the collar 59.

Accordingly, the supported portion 71*b* of the flange member 71 is restricted such that the radial position thereof is restricted within a predetermined range by the associated collar 59 and the restricting screw loosely inserted into the hole thereof, and the axially upward displacement (the displacement toward the external container) thereof is restricted by the planar washer 74. The elastic and viscous member 54 interposed between the supported portion 71*b* of the flange member 71 and the support fixing portion 73*a* of the supporting member 73 elastically supports the flange member 71 such that the viscous friction acts onto the flange member 71 depending on the moving speed thereof with respect to the support fixing portion 73*a*.

The circumferential end portion of the elongated portion 73*b* of the support member 73 is located below the inlet port 71*c* circumferential portion of the flange member 71 (i.e. in the base 19 side in the axial direction of the rotor member), and a passage hole is defined, which is circumscribed by the circumferential end portion of the elongated portion 73*b*. This passage hole is substantially as large as the inlet port 71*c* of the flange member 71.

An O-ring 62 is interposed between the joint portion 73*c*, formed in a root (i.e. the support fixing member 37*a* side) of the elongated portion 73*b* of the support member 73, and the end portion circumference of the outer cylindrical member 16. The supporting member 73 is connected to the outer cylindrical member 16 only through the O-ring 62 and the first insulative sheet 55, and other portions of the supporting member 73 are separated from the outer cylindrical member 16. Accordingly, in this embodiment, the outer cylindrical member 16 and the supporting member 73 are electrically insulated from each other by the O-ring 62, the first insulative sheet 55 and the second insulative sheets 56, thereby electrically insulating the outer cylindrical member 16 from the external container.

The bellows 57 is disposed between the inlet port 71*c* circumferential end portion of the flange member 71 and the circumferential end portion of the passage hole of the elongated portion 73*b*. The spring constant of the bellows 57 in the axial direction of the rotor member is smaller than the spring constant of the elastic and viscous member 54 in the axial direction of the rotor member.

The inlet port 71*c* of the flange member 71 is connected to the hollow portion of the outer cylindrical member 16 through the bellows 57, the elongated portion 73*b* of the supporting member 73 and the O-ring 62.

As shown in FIG. 5, the rotor shaft 12 is located inwardly of the stator shaft 15, and supported rotatably such that one end (an upper portion) thereof is exposed from the interior of the stator shaft 15. A magnet or magnets 33 of a motor 21 is fixed to the substantially central portion of the rotor shaft 12 in the axial direction.

The rotor body 14 has a substantially cylindrical, circumferential wall portion 14*a* disposed to circumscribe the outer circumference of the stator shaft 15, a support portion 14*b* closing a hollow portion of the circumferential wall portion 14*a*, and rotor blades 141 attached to the outer circumference of the circumferential wall portion 14*a*. The support portion 14*b* is fixed to the upper portion of the rotor shaft 12 exposed externally of the stator shaft 15 so as to be rotated together with the rotor shaft 12.

The rotor blades 141 are arranged as multiple stages in the axial direction onto the circumferential wall portion 14*a*, and each of the rotor blades 141 is formed with a plurality of radially protruded blades (fans). Each of the fans is inclined at a predetermined angle so that the inlet portion 38 side (the upper side in the drawing) is the rotational direction side and each fan collides against the gas molecular to be moved toward the outlet port 49 side.

The stator shaft 15 is provided with a cylindrical portion 15*a* that is integrally formed on the base 19 so as to be coaxially with respect to the rotor blades 141.

The cylindrical portion 15*a* is elongated from the base 19 to extend into a clearance between the circumferential wall portion 14*a* of the rotor body 14 and the rotor shaft 12. A coil(s) 32 of the motor is fixed to the inner circumferential wall of the cylindrical portion 15*a* to be confronted with the magnet(s) 33, and the coil(s) 32, through which the current flows, urges the magnet(s) 33 to rotate the rotor shaft 12.

The stator body 18 has spacers 180, and stator blades 181, each of which is supported at its outer circumferential side by and between respective adjacent spacers 180 to be disposed between respective adjacent stages of the rotor blades 141.

The spacers 180, each in the form of a cylinder having a stepped portion, are stacked one on another in the interior of the outer cylindrical member 16.

In the turbo-molecular pump of this embodiment, the magnetic shielding member 66 having a thickness of 1/100 to 1/10 mm orders is disposed between the outer cylindrical member 16 and the spacers 180 to circumscribe the spacers 180. As the magnetic shielding member 66, one that employs an amorphous alloy or a nano crystal alloy as a soft magnetic material can be used. The magnetic shielding member 66 can be formed, for instance, such that a plurality of magnetic thin bands made of the amorphous alloy or the nano crystal alloy are arranged parallelly with their end portions partially overlapped with one another to form an integral assembly with resin, and a conductive member is disposed on at least one surface of the integral assembly (see Japanese Patent Application Laid-open No. Hei 1-87989).

As an example of the amorphous alloy, a material of Cu1-Nb3-Si15-B6 (atomic %) with the rest being Fe, a material of Fe2-Mn2-Cr3-Si13-B9 (atomic %) with the rest being Co or a material obtained by subjecting each of these amorphous alloy to a thermal treatment not higher than a crystallization temperature can be adopted. As an example of the nano crystal alloy, a material obtained by subjecting the above-described amorphous alloy to the thermal treatment not lower than the crystallization temperature to form fine crystal.

The stator blade 181 includes an outer annular portion, the outer circumferential portion of which is partially clamped by the spacers 180 in the circumferential direction, an inner annular portion disposed inwardly of and coaxially to the outer annular portion, and a plurality of stator blades (fans), radial ends of which are respectively supported by the outer and inner annular portions radially with a predetermined angle spaced therebetween. The inner diameter of the inner annular portion is larger than the outer diameter of the circumferential wall portion 14*a*, so that the inner circumferential surface of the inner annular portion is confronted with the outer circumferential surface of the circumferential wall portion 14*a* with a clearance therebetween.

The stator blade 181 is circumferentially divided into two parts so that the stator blade 181 can be disposed between the rotor blades 141 and 141 of the adjacent stages. The stator blade 181 is formed by preparing a thin plate, made, for instance, of stainless steel or aluminum steel, and divided into two parts, cutting out or separating from each part of a member having a semi-circular outer diameter portion and portions corresponding to the fans of the stator blade through an etching process or the like, and bending the portions corresponding to the fans of the stator blade to have a predetermined angle through a pressing process.

The stator blade 181 in each stage is clamped at its outer annular portion by the adjacent spacers 180 circumferentially so as to be held between the rotor blades 141.

In the base 19, an outlet port 49 is disposed, from which the gas transferred between the rotor blades 141 and the stator blades 181 is discharged externally. The base 19 is formed with a circuit board accommodating portion 40 for accommodating a circuit board therein. In the circuit board accommodating portion 40, a rotational speed sensor 41 for detecting a rotational speed of the rotor shaft 12 and other components are installed. The base 19 is equipped with a connector 42, so that a signal from the rotational speed sensor 41 is transmitted to a control system 36 through a cable 43 connected thereto. Based on this signal, the control system 36 controls the rotation of the rotor shaft 12.

The turbo-molecular pump of this embodiment is further provided with a magnetic bearing 20 for supporting the rotor shaft 12 through a magnetic force.

The magnetic bearing 20 is designed as three axes controlled magnetic bearing, and has a radial electromagnet 22 for applying a radial magnetic force to the rotor shaft 12, a radial sensor 30 for detecting a radial positional displacement of the rotor shaft 12, an axial electromagnet 26 for applying an axial magnetic force to the rotor shaft 12, and a metal disk 31 on which the axial force by the axial electromagnet 26 acts, and an axial sensor 34, disposed inside the circuit board accommodating section 40, for detecting an axial displacement of the rotor shaft 12.

The radial electromagnet 22 includes two pairs of electromagnets (one pair is only shown in the drawing) that are fixedly disposed on the inner circumferential surface of the stator shaft 15 to be orthogonal to the other pair. The electromagnets in each pair are disposed at the upper portion of the rotor shaft 12 above the motor 21, and confronted with each other through the rotor shaft 12 located therebetween.

Above the radial electromagnets 22, two pairs of radial sensors 30 (one pair is only shown in the drawing) are provided, such that the radial sensors 30 in each pair are confronted with each other through the rotor shaft 12 located therebetween. The two pair of the radial sensors 30 are disposed so that one pair is orthogonal to the other pair, correspondingly to the two pairs of the radial electromagnets 22.

By supplying exciting currents to the radial electromagnet 22 and the axial electromagnet 26, the rotor shaft 12 is magnetically floated. During the magnetic floating, the exciting current to the radial electromagnet 22 is controlled based on the displacement detection signals from the radial sensors 30 so that the rotor shaft 12 is held at a predetermined position radially.

The circular, metal disk 31 formed of a magnetic material is fixed to the lower portion of the rotor shaft 12. Above the metal disk 31, the axial electromagnet 26 is fixedly disposed on the base 19. The axial sensor 34 is disposed within the circuit board accommodating portion 40 to be confronted with the lower end portion of the rotor shaft 12 and to detect the axial position of the rotor shaft 12.

The exciting current to the axial electromagnet 26 is controlled based on the displacement detection signal from the axial sensor 34, so that the rotor shaft 12 is held at a predetermined position axially.

The magnetic bearing 20 is provided with magnetic bearing control means which magnetically floats the rotor shaft 12 by feed-back control of exciting currents to the radial electromagnet 22 and the axial electromagnet 26 based on the detection signals from the radial sensor 30 and the axial sensor 34, and which is installed within the control system 36 connected through the connector 42 disposed on the base 19 and the cable 43.

Since this magnetic bearing can hold the rotor shaft 12 at the predetermined position, the rotor portion (the rotor shaft 12 and the rotor body 14) is unlikely to be mechanically contacted with the stator shaft 15 and the stator body 18 during the activation of the magnetic bearing, thereby suppressing the generation of particles. Further, the use of this magnetic bearing can dispense with sealing oil or the like, thereby eliminating the generation of gas. Accordingly, the rotational driving of the rotor portion under a clean environment can be realized. For this reason, the turbo-molecular pump using the magnetic bearing is suitable for a case where high cleanness is required, such as the manufacture of the semiconductor devices.

In the turbo-molecular pump of this embodiment, touch down bearings 38 and 39 are respectively disposed at the upper and lower portion sides of the rotor shaft 12.

Normally, the rotor shaft 12 and the components mounted thereto to form the rotor body 14 are supported in a non-contact fashion by the magnetic bearing 20 during the rotation. The touch down bearings 38 and 39 serve as protective bearings for the entire apparatus, which support the rotor portion in place of the magnetic bearing 20 when the touch down occurs.

Therefore, each of the touch down bearings 38 and 39 is disposed such that the inner race thereof is in non-contact with the rotor shaft 12.

In the turbo-molecular pump of this embodiment as constructed above, the mounting portion 71*a* of the flange member 71 is fixed to the external container and then the motor 21 is driven to rotate the rotor shaft 12 and the rotor body 14 together. The rotor body 14 is rotated at a high speed of a rated value (20,000 to 50,000 rpm) and thus the rotor blades 141 are rotated at the high speed. This allows the gas from the inlet port 71*c* to be transferred by the rotor blades 141 and discharged from the outlet port 49.

During the rotational driving of the turbo-molecular pump, the vibrations are caused on the coil 32 of the motor 21 and the core of the coil 32 due to rotating magnetic field of the motor 21, and vibrations are caused on the coil of the radial electromagnet 22 and the core of the coil due to the rotor unbalance and dimensional error. These vibrations are propagated from the stator shaft 15, onto which the coil 32, the core of the coil 32, the coil of the radial electromagnet 22 and the core of the coil are fixed, to the base 19, and further propagated from the base 19 directly to or through bolts 161 to the outer cylindrical member 16.

In the case where a back pump is connected to the outlet port 49 of the turbo-molecular pump or the like, vibrations or the like of the back pump are propagated to the base 19 through a connection pipe and the outlet port 49 or through the floor on which these pumps are installed, and further propagated from the base 19 directly to or through the bolts 161 to the outer cylindrical member 16.

These vibrations, when transmitted from the outer cylindrical member 16 to the supporting member 73, are attenuated by the elastic and viscous member 54 and the bellows 57, and then transmitted to the flange member 71.

As described above, since the flange member 71 formed as a separate member from the outer cylindrical portion 16 is supported to the outer cylindrical member 16 through the elastic and viscous member 54 and the bellows 57 in this embodiment, the vibrations caused by the motor and the magnetic bearing within the pump during the driving of the turbo-molecular pump and the vibrations caused by the external factors, such as vibrations propagated from the back pump or other members are both attenuated by the elastic and/or viscous member 54 and the bellows 57 and then propagated to the flange member 71. Consequently, the propagation of vibrations from the outer cylindrical member 16 to the external container can be reduced to thereby suppress the vibrations on the external container.

In this embodiment, the flange member 71 is formed as a separate member from the outer cylindrical portion 16, and is supported through the supporting member 73 and the elastic and/or viscous member 54 by the outer cylindrical member 16. Accordingly, in this embodiment, a member (the elastic and/or viscous member 54) for attenuating the vibrations from the outer cylindrical portion 16 to the external container is disposed, and the flange member 71 is supported with respect to the outer cylindrical portion 16 at the outward location in the radial direction of the rotor member. Therefore, the size in the axial direction is not increased in comparison to a case where an elastic and/or viscous member such as a damper is disposed between the flange formed on the outer cylindrical member 16 and the external container as in the related art.

In this embodiment, since the propagation of the vibrations from the outer cylindrical member 16 is reduced by the elastic and/or viscous member 54 in the turbo-molecular pump, it is unnecessary to attach a vibration suppressing member. Accordingly, the increase in labor and cost to attach the vibration attenuating member between the external container and the turbo-molecular pump, the non-stability in gas sucking performance and the lowering of the durability in association with the attachment of the vibration attenuating member between the external container and the turbo-molecular pump or the like can be eliminated.

By jointly using a vibration attenuating member between the external container and the turbo-molecular pump, the propagation of the vibration can be further reduced.

In this embodiment, the elastic and/or viscous member 54 made of the elastic and viscous material and the bellows 57 made of the elastic member are disposed between the flange member 71 and the outer cylindrical portion 16 in a juxtaposed manner, the propagation of the vibrations from the outer cylindrical portion 16 to the flange member 71 is reduced by a spring-dashpot system of vibration engineering.

In this embodiment, since two kinds of elastic mechanisms (the elastic and/or viscous member 54 and the bellows 57) having respective different spring constants are juxtaposed, and the bellows 57 is disposed in the gas passage side, the flange member 71 can be supported to the outer cylindrical portion 16 by the spring-dashpot system constructed by the elastic and/or viscous member 54 and the bellows 57 while hermetically sealing the gas passage side from the exterior side by the bellows 57. Consequently, it is possible to reduce the propagation of the vibrations from the outer cylindrical portion 16 to the external container while maintaining an excellent vacuum efficiency. Further, in this embodiment, the elastic and/or viscous member 54 having a large spring constant and the bellows 57 having a small spring constant are juxtaposed. Therefore, even if the motor 21 is driven to decrease the pressure within the outer cylindrical portion 16 and the axial load due to the atmospheric pressure acts on the bellows 57, the bellows 57 is prevented from contracting beyond a tolerable degree and thus the damage of the bellows 57 can be avoided. Further, the inlet port 71*c* of the flange member 71 and the elongated portion 73*b* of the supporting member 73 are connected to the bellows 57 in a hermetically sealed state by welding or the like. Accordingly, the sealed gas passage is formed between the flange member 71 and the supporting member 73, thereby surely preventing the molecular of the elastic and/or viscous member 54 and other components, and the external gas from being mixed into the interior of the pump.

In this embodiment, the displacement of the flange member 71 with respect to the outer cylindrical member 16 is restricted to a predetermined range. Therefore, even if a large load is caused due to, for example, the breakage of the rotor member (the rotor blades 141, the circumferential wall portion 14*a* and the rotor shaft 12 in this embodiment) during the rotation, the flange member 71 is hardly dislocated from the supporting member 73, and the turbomolecular pump of this embodiment is less likely to be removed from the external container and moved around independently. Thus, a high safety can be secured.

In this embodiment, since the sheet-like magnetic shielding member 66 is disposed between the outer cylindrical portion 16 and the spacers 180, it is possible to eliminate the external leakage of the magnetic fields by the coil 32 of the motor 21 disposed on the stator shaft 15, the radial electromagnet 22 of the magnetic bearing 20, the radial sensor 30 and magnet 33 of the motor 21 fixed to the rotor shaft 12. Further, since the magnetic shielding member 66 is disposed outwardly of the stator member and the rotor member, and spaced from the above-described components generating the magnetic fields with certain distances, the leakage of the magnetic fields can be effectively eliminated with a reduced thickness thereof. Accordingly, the cost of the magnetic shielding member 66 and the installation spacer therefor can be suppressed. In this embodiment, the magnetic shielding member is disposed using a clearance existing between the outer cylindrical member 16 and the spacers 180 in the related art. Further, since the magnetic shielding member 66 is disposed inwardly of the outer cylindrical member 16, the outer shielding member 66 is protected from the exterior of the pump by the outer cylindrical member 16 and thus is less likely to be damaged.

In this embodiment, the O-ring 62, the first insulative sheet 55 and the second insulative sheets 56 electrically insulate the outer cylindrical member 16 from the supporting member 73, whereby the outer cylindrical member 16 is electrically insulated from the flange member 71. Accordingly, it is possible to suppress the propagation of electric noises, which are induced by variations of currents flowing through the coil 32 of the motor, and the radial electromagnet 22 and the axial electromagnet 26 of the magnetic bearing 20 or by rotating magnetic field of the magnet 33, to the external container.

As described above, this embodiment is designed to suppress the propagation of all of the vibrations, the leakage of the magnetic fields, and the electric noises to a vacuum apparatus, which may cause the lowering of the performance, the reliability and the service life of the vacuum apparatus when the turbomolecular pump is connected to and used together with the vacuum apparatus of an electronic microscope or the like.

In addition, the vacuum pump of the present invention should not be restricted to the aforementioned second embodiment, and the configuration, size, material, arrangement or the like of each component/means can be modified appropriately without departing from the spirit and scope of the present invention.

For example, although the supporting member 73 serving as supporting means is fixed to the outer circumference side of the outer cylindrical member 16 in the second embodiment described above, the supporting means may be fixed to the inner circumference side of the outer cylindrical member 16. In this case, using a space existing in a related art and extending from the inlet port to the rotor portion and the stator portion, the supporting member 73, the elastic and viscous member 54, and the communicating member (the bellows 57) can be disposed to suppress the increase in size in the axial direction.

In the second embodiment and the modification thereof described above, the supporting member 73 and the elastic and viscous member 54 made of the elastic and viscous material are used as the supporting means, and the bellows 57 is used as the communicating means. However, for example, the bellows 57 may not be used, and instead, the supporting member 73 and the elastic and viscous member 54 may additionally have the function of the communicating member. Further, only the bellows may be used without the use of the elastic and viscous member 54.

In the second embodiment and the modifications thereof described above, the rotor blades 141 are protruded outwardly from the outer circumferential surface of the circumferential wall portion 14*a*. However, the rotor blades may be protruded inwardly from the inner circumferential surface of the circumferential wall portion 14*a*, and the stator body 18 may be disposed radially inwardly of the rotor body 14.

Further, in the second embodiment and the modifications thereof described above, the rotor shaft 12 is supported by the magnetic bearing, but the present invention should not be limited thereto. The rotor shaft 12 may be supported by a dynamic pressure bearing, a static pressure bearing or any other bearing.

In the second embodiment and the modifications thereof described above, the vacuum pump is constructed as the turbomolecular pump having the rotor blades 141 and the stator blades 181. The vacuum pump may be constructed as a thread groove-type pump in which a thread groove is arranged in the rotor body 14 or the stator body 18 in order to transfer the gas using the viscosity of the gas when the rotor portion is rotated, or may be constructed as a composite pump in which the turbo-molecular pump is combined with the thread groove-type pump.

In the second embodiment and the modifications thereof described above, the elastic and/or viscous member 54 formed of a rubber and the bellows 57 are used as the vibration absorbing means, but the vibration absorbing means should not be restricted thereto. A spring member or a gel member formed of a gel material may be used as the vibration absorbing means. As the spring member, a leaf spring, a coiled spring, a disk spring or the like can be adopted. As the gel member, a gel member formed of a gel material such as silicon, or the like can be adopted.

In the second embodiment and the modifications thereof described above, the flange member 71 serving as the flange portion and the outer cylindrical member 16 serving as the outer cylindrical portion are formed as discrete members, and the elastic and viscous member 54 serving as the vibration absorbing means is disposed at the joint portion where the flange member 71 is connected to the outer cylindrical portion 16. The vibration absorbing means can be disposed at, in addition to or in place of the joint portion between the flange member and the outer cylindrical member, any one or more of locations including the flange portion, the outer cylindrical portion, the base, the stator portion, the joint portion between the outer cylindrical portion and the base, and the joint portion between the stator portion and the base. In the case where the vibration absorbing means is disposed at a location or locations other than the joint portion between the flange portion and the outer cylindrical portion, the flange portion and the outer cylindrical portion may be formed integral with each other.

As described above, according to the vacuum pump of the first to twelfth aspects of the present invention, the propagation of the vibration to the external container can be reduced without using the damper disposed outside the vacuum pump.

According to the tenth aspect of the present invention, it is possible to suppress the propagation of the vibration from the outer cylindrical portion to the flange portion, and restrict the displacement of the flange member to the predetermined range with respect to the outer cylindrical portion. Therefore, even in the case where a large impact such as the breakage of the rotor member during rotation occurs, the flange member is less likely to be dislocated from the supporting member, and the turbo-molecular pump is less likely to be removed from the external container and moved around independently. Thus, a high safety can be secured.

According to the eleventh aspect of the present invention, it is possible to eliminate the external leakage of the magnetic flux while suppressing the increase in size and cost.

According to the twelfth aspect of the present invention, it is possible to suppress the propagation of the electric noise to the external container.

What is claimed is:

1. A vacuum pump comprising:

an outer cylindrical portion to be connected to an external container, the outer cylindrical portion having one end portion provided with an inlet port through which a gas within the external container is sucked;

a rotor portion rotatably accommodated within the outer cylindrical portion;

a stator portion disposed within the outer cylindrical portion, the stator portion and the rotor portion cooperatively defining a transferring portion for transferring the gas sucked through the inlet port;

a magnetic bearing for floatingly supporting the rotor portion;

a motor portion for rotatingly driving the rotor portion;

a base supporting the outer cylindrical portion and the stator portion at the other end portion of the outer cylindrical member; and a vibration absorbing member, interposed between at least one of the outer cylindrical portion and the stator portion and the base, for displaceably supporting the at least one of the outer cylindrical portion and the stator portion with respect to the base, wherein the vibration absorbing member has a natural frequency F meeting the following formula:

$$F=(f1+f3)/2\pm(f1-f3)/4$$

where f1, f2 and f3 respectively denote a natural frequency of nutation in conical mode, a natural frequency in parallel mode and a natural frequency of procession in the conical mode, when the rotor portion is rotated at a rated speed.

2. A vacuum pump as claimed in claim 1, wherein the vibration absorbing member includes a silicon gel.

3. A vacuum pump as claimed in claim 1 or 2, wherein the vibration absorbing member is interposed between the stator portion and the base, and the vacuum pump further comprises displacement restricting means for restricting a range where the stator portion is displaceable with respect to the base.

4. A vacuum pump as claimed in claim 3, wherein:

the stator portion includes a protruded portion protruded substantially parallel to a plane defined by the base;

a plurality of restricting holes are arranged circumferetially in the protruded portion;

the displacement restricting means includes restricting bolts and restricting members, the restricting bolts being formed of a material higher in rigidity than that of the vibration absorbing member, each of the restricting bolts being loosely inserted into the respective restricting holes with a leading end thereof fixed to the stator portion; and each of the restricting member has:

a restricting cylinder that is fixed around a shaft of each of the restricting bolts, and that is spaced from an circumferetial surface of each of the restricting holes of the protruded portion; and two disk portions that are extended outwardly from respective end portions of the restricting cylinder and that are disposed opposite from each other with respect to the protruded portion while being spaced from the protruded portion.

5. A vacuum pump comprising:

a flange portion to be connected to an external container, the flange portion having an inlet port through which a gas within the external container is sucked;

an outer cylindrical portion having one end side connected to or integral with the flange portion;

a base connected to the other end side of the outer cylindrical portion, the base, the flange portion and the outer cylindrical portion cooperatively defining a hollow portion communicating with an interior of the external container through the inlet port;

a stator portion supported to the base, and accommodated within the hollow portion;

a rotor portion accommodated within the hollow portion;

a bearing rotatably supporting the rotor portion with respect to the stator portion;

a motor portion for rotatingly driving the rotor portion, supported by the bearing, with respect to the stator portion; and vibration absorbing means, including a material having a vibration absorbing property, for reducing propagation of vibration using elastic and/or viscous property, the vibration absorbing means being disposed at at least one of the flange portion, the outer cylindrical portion, the base, the stator portion, and joint portions respectively connecting two members selected from the flange portion, the outer cylindrical portion, the base, and the stator portion.

6. A vacuum pump as claimed in claim 5, wherein:

the outer cylindrical portion has an outlet port through which the gas within the hollow portion is discharged; and the vibration absorbing means is disposed at at least one of the flange portion, the outer cylindrical portion and the joint portion connecting the outer cylindrical portion and the flange portion.

7. A vacuum pump as claimed in claim 5 or 6, wherein:

the base has an outlet port through which the gas within the hollow portion is discharged; and the vibration absorbing means is disposed at at least one of the flange portion, the outer cylindrical portion, the base, and joint portions respectively connecting two members selected from the flange portion, the outer cylindrical portion, and the base.

8. A vacuum pump as claimed in claim 5, wherein the vibration absorbing means includes at least one of a spring member, a rubber member formed of a rubber, a gel member formed of a gel material and a bellows.

9. A vacuum pump as claimed in claim 5, wherein:

the flange portion is discrete from the outer cylindrical portion; and the vibration absorbing means is disposed at the joint portion connecting the flange portion and the outer cylindrical portion.

10. A vacuum pump as claimed in claim 9, further comprising:

restricting means for restricting a position of the flange portion to a predetermined range with respect to the outer cylindrical portion.

11. A vacuum pump as claimed in claim 5, further comprising:

a magnetic shielding member in the form of a sheet, which is disposed radially outwardly at the stator portion and the rotor portion to circumscribe the stator portion and the rotor portion, and which is disposed along an inner circumferential surface of the outer cylindrical portion.

12. A vacuum pump as claimed in claim 5, further comprising:

an insulative portion formed of an electrically high-insulative resistance material, which is disposed at the joint portion connecting the outer cylindrical portion and the flange portion.

* * * * *